US009839827B1

(12) United States Patent
Roberts

(10) Patent No.: US 9,839,827 B1
(45) Date of Patent: Dec. 12, 2017

(54) EXERCISE ASSEMBLY

(71) Applicant: Larry Roberts, Ft. Lauderdale, FL (US)

(72) Inventor: Larry Roberts, Ft. Lauderdale, FL (US)

( * ) Notice: Subject to any disclaimer, the term of this patent is extended or adjusted under 35 U.S.C. 154(b) by 0 days.

(21) Appl. No.: 14/924,340

(22) Filed: Oct. 27, 2015

Related U.S. Application Data

(60) Provisional application No. 62/236,503, filed on Oct. 2, 2015, provisional application No. 62/177,730, filed on Mar. 23, 2015, provisional application No. 62/122,685, filed on Oct. 27, 2014.

(51) Int. Cl.

| | |
|---|---|
| ***A63B 69/32*** | (2006.01) |
| ***A63B 69/20*** | (2006.01) |
| ***A63B 23/12*** | (2006.01) |
| ***A63B 69/00*** | (2006.01) |

(52) U.S. Cl.
CPC ..... *A63B 69/208* (2013.01); *A63B 23/12* (2013.01); *A63B 69/004* (2013.01)

(58) Field of Classification Search
USPC ..... 482/1–148
See application file for complete search history.

(56) References Cited

U.S. PATENT DOCUMENTS 2,435,864 A * 2/1948 Adams ..... A63B 69/20 482/90
4,564,192 A * 1/1986 Lebowitz ..... A63B 69/004 446/334
4,749,184 A * 6/1988 Tobin ..... A63B 69/0091 482/129
4,817,941 A * 4/1989 McCorry ..... A63B 69/004 482/87
5,277,679 A * 1/1994 Wells ..... A63B 69/004 482/83
5,342,267 A * 8/1994 Adams ..... A63B 69/004 482/83
5,538,251 A * 7/1996 Harper ..... A63B 69/365 473/229
5,722,920 A * 3/1998 Bauer ..... A63B 69/004 482/83
5,899,835 A * 5/1999 Puranda ..... A63B 69/34 482/83
6,033,348 A * 3/2000 Warshauer ..... A63B 69/004 482/83
7,086,997 B1 * 8/2006 Fields ..... A63B 69/004 482/83
8,617,034 B2 * 12/2013 Eem ..... A63B 69/203 482/83

(Continued)

*Primary Examiner* — Stephen R Crow
(74) *Attorney, Agent, or Firm* — Malloy & Malloy, P.L.

(57) ABSTRACT

An improved exercise assembly structured to be struck by a user includes a base supporting a shaft on a supporting surface. A support shaft extends outwardly from the supporting surface. At least one rotating targets is connected to the support shaft and extends outwardly. A resistance assembly is adjustably mounted on the shaft into and out of a position relative to a path of travel of at least one rotating target. The position includes the resistance assembly in engagement with at least one rotating target. The rotating target includes an elongated arm including a predetermined weighted construction and a safety portion thereon.

24 Claims, 6 Drawing Sheets

(56) References Cited

U.S. PATENT DOCUMENTS

| | | | | |
|---|---|---|---|---|
| 2007/0167297 | A1* | 7/2007 | Stevenson | A63B 69/004 482/83 |
| 2014/0128227 | A1* | 5/2014 | Ladas | A63B 69/32 482/84 |
| 2014/0302969 | A1* | 10/2014 | Chen | A63B 69/203 482/90 |
| 2014/0329646 | A1* | 11/2014 | Johnson | A63B 69/004 482/83 |
| 2016/0023078 | A1* | 1/2016 | Haselrig | A63B 69/004 482/87 |

* cited by examiner

EXERCISE ASSEMBLY

CLAIM OF PRIORITY

The present application is based on and a claim to priority is made under 35 U.S.C. Section 119(e) to provisional patent application currently in the U.S. Patent and Trademark Office, Ser. No. 62/236,503 and a filing date of Oct. 2, 2015 which also claims priority to provisional patent application having Ser. No. 62/177,730 and a filing date of Mar. 15, 2015, which also claims priority to provisional patent application having Ser. No. 62/122,685 and a filing date of Mar. 27, 2014, the entirety of which is incorporated herein by reference.

BACKGROUND OF THE INVENTION

Field of the Invention

The present invention is directed to an exercise assembly which also may be used for training purposes when practicing certain sports activity including, but not limited to, boxing, the martial arts, etc. As such, the exercise assembly includes a plurality of targets, adjustably mounted and disposed on a supporting shaft, wherein each target is structured to be individually and repeatedly struck by the hands, feet, and/or limbs of a user when performing the exercising and/or training routine.

Description of the Related Art

Numerous individuals seek out training devices wanting to exercise or train using self defense techniques. As a result, such individuals frequently require some type of device in order to facilitate their goals. Known devices which are readily available on the commercial market include stationary training products including the heavy punching bag. However, there is always a risk of injury since the bag is by nature heavy and dense, and can damage wrists and ankles if the user does not properly protect his/her body. Other known devices such as reactive training products including various speed bag assemblies allow an individual to practice not only punches and/or kicks, but also speed and accuracy.

Training devices have independently developed to a point where their use is more multi-purpose, where a target can rotate on contact back to the individual, which simulates the unpredictable nature of a real-life sparring partner. However, there appears to be an absence of a combined structure having multi-purpose uses such that a single exercise training device may be utilized as both a stationary training product and a simulated interactive sparring partner where a target can rotate around a shaft on contact from the user. Accordingly, despite the developments and advancements in training devices of the type set forth above, there is still a need for an improved training apparatus which provides targets that simulate an interactive sparring partner with a high enough threshold for absorbing impact, while remaining safe to the user.

SUMMARY OF THE INVENTION

The present invention is directed to an exercise assembly including structural and operative features which facilitates its versatility, thereby allowing it to be used for both exercise and training. More specifically, the exercising and/or training assembly of the present invention is structured with the intent of being repeatedly "struck" by a participating user, as the user simulates activities relating to boxing techniques, the performance of various types of martial arts and/or similar activities.

Accordingly, at least one preferred embodiment of the exercise assembly includes an elongated support shaft or support stanchion which may be mounted on or otherwise connected to different supporting surfaces. As primarily but not exclusively used, the support shaft may be disposed in a vertically upright orientation resting on a supporting surface such as a floor, ground surface or the like. Further, a base may be removably connected to a lower or proximal end of the support shaft while being fixedly or removably connected to the supporting surface. Other anticipated operative orientations of the exercise assembly include the support shaft being mounted in what may be referred to as a substantially "inverted orientation" such as by depending from a ceiling or other raised surface area. Similarly, the support shaft and an appropriately structured base may be secured to a vertical wall so as to extend transversely outward therefrom.

The versatility of the exercise and/or training assembly of the present invention is enhanced by the utilization of a plurality of different types of target structures. Each of the targets may be adjustably mounted along the length of the shaft so as to be positioned at various heights and at various spacings relative to one another. As such, the specific disposition of each of the plurality of targets may be at least partially dependent on the stature of a user. Similarly, the space between and/or relative positioning of the various targets on the shaft may also be dependent on the type of training and/or exercise activity intended to be performed. By way of example, if a user is intending to practice boxing, the plurality of targets are relatively disposed on the shaft so as to facilitate the user throwing different types of punches with the arms and hands. However, if the user is intending to practice different types of martial arts and/or a combination of boxing and martial arts, the plurality of targets may be arranged along the height or length of the shaft at different locations to facilitate the performance of such activity.

Therefore, the exercise assembly of the present invention includes at least one but a possible plurality of fixed, moving, rotating targets adjustably mounted, relative to one another, along the length of the shaft at appropriate positions. In at least one preferred embodiment, the exercise assembly may include at least one but possibly a plurality of rotating targets. Each of the one or more rotating targets includes an elongated arm having both a weighted construction and a safety portion. As explained in greater detail hereinafter, the weighted construction provides the proper overall weight to the elongated arm so as to facilitate its rotation about the shaft in an intended manner, after being struck by the user. Such a weighted construction may include an elongated rigid material member, such as an elongated dowel, disposed within the interior of the arm and extending along a length thereof, substantially intermediate the proximal and distal ends of the arm.

In contrast, the safety portion of the arm of the rotating target may be located along a length contiguous to the distal end of the arm. Further, in order to eliminate or at least restrict the possibility of damage or harm to the user, the safety portion is preferably made of a cushioning material. Such cushioning material may be in the form of a flexible material foam or the like. The safety features associated with the flexible cushioning material are such as to offer at least an appropriate minimal resistance to a punch or blow from the user. Such resistance should be sufficient to facilitate the rotation of the rotating target, once struck, but should be such as to not cause damage to the user's hand, arm, etc. In order to further facilitate the safety features of the one or more rotating targets, the corresponding elongated arm may include an outer sleeve of similarly flexible cushioning and/or foam material. This is due, at least in part to the fact that a continuous rotation of the arm may possibly result in its striking or otherwise engaging the user after completion of a substantially 360° path of rotation about the central axis of the shaft.

As explained in greater detail hereinafter, structural and operative features associated with at least one embodiment of the one or more rotating targets and corresponding arms include the intended rotation thereof through a plurality of continuous rotational paths, in order to provide a greater challenge to the user when performing certain exercises and/or training programs. Accordingly, additional features which facilitate the rotation of the one or more arms defining the one or more rotating targets include the provision of a rotational fitting. Each of the rotational fittings include a one piece and/or integrally formed primary portion and outwardly extending connecting segment. As such, the primary portion and connecting segment may collectively define a substantially T-shape configuration. Moreover, the primary portion has a hollow interior which allows its disposition in surrounding, concentric relation to an exterior of the shaft. However, the relative dimensions between the interior of the primary portion of the rotational fitting and the exterior dimensions of the shaft should be such as to allow the aforementioned intended rotation.

As will also be explained in greater detail hereinafter, the continuous and/or intended rotation of the one or more rotating targets is facilitated by the rotational fitting including two bearing assemblies each disposed at an opposite open end of the primary portion. Further, each bearing assembly is secured by a correspondingly disposed one of two locking collars. Additional features of the preferred bearing assembly include two spaced apart bearing washers disposed in sandwiching relation with an inner bearing structure, such as a thrust bearing.

As set forth above, one intended operation of the rotating target is for the overall structuring, including the weighted construction and the rotational fitting to facilitate a continuous rotation of the elongated arm through a predetermined plurality of preferably three to four complete rotations once being struck by the user. This will further facilitate the performance by a user of a relatively quick or rapid response movement when practicing either a boxing or martial arts technique, since the user will have to respond to the continuously rotating arm of the rotating target.

However, yet another operative feature of the rotating target is its intended restricted rotation through a rotational path of less than 360° or less than a complete circular path about the longitudinal axis of the shaft. Accordingly, the exercise and/or training assembly of the present invention further comprises a resistance assembly which is adjustably but fixedly secured in a predetermined location relative to the rotational path of one or more of a possible plurality of arms of one or more rotating targets. Therefore, the resistance assembly may be purposefully disposed in an "interruptive position" relative to the rotational path of the arm. As such rotation of the arm will be restricted and/or prevented from accomplishing a complete 360° arc of rotation.

Further, the resistance assembly may include a biasing or spring structure which is disposed to engage the arm during its rotation. In addition, the biasing structure is disposed and structured to direct a directional, biasing force on the rotating arm, which will not only stop its rotation, but force it to rotate in an opposite direction, back towards the user. More specifically, the biasing structure of the resistance assembly will exert a force on the rotating arm in a direction which is substantially opposite to the initial direction of rotation of the arm along its intended rotational path of travel. This will serve to redirect the rotating arm back towards the user. In turn, the user can appropriately react by purposefully "ducking" the returning rotating arm and or delivering an additional defensive blow thereto, dependent on the particular exercise or training activity which the user is practicing.

The versatility of the exercise assembly of the present invention is further demonstrated by the provision of a head target. The head target includes a support member which is preferably a rigid arm segment adjustably secured along the length of the shaft and thereby disposed at any preferred or appropriate height. A target section defines a distal end of the head target and is structured to be struck or receive a blow from the user. In addition, a spring segment is included in the head target and is disposed in movably, resiliently interconnecting relation between an outer end of the support arm segment and the inner or proximal end of the target section. Further, the spring segment may have a substantially conical configuration. As such, the conically configured spring extends divergently is corresponding outward in at least partially surrounding and/or gripping relation to the proximal end of the target section. Such structuring of the head target also facilitates its use as a "speed bag". In order to provide a more realistic appearance and disposition of the head target it may be disposed at an acute angle relative to the length of the shaft and be directed either upwardly or downwardly at such an acute angle.

The exercise assembly of the present invention may also include one or more fixed targets which may be similarly structured to the head target by the inclusion of a support arm segment, a target portion or section structured, to receive a blow from the user, and a resilient, spring segment. The spring element in both the head target and one or more fixed targets will be calibrated and/or otherwise structured to absorb the force of a blow exerted on the target section, but cause a return the target section to an original orientation. Such one or more fixed targets may be strategically or appropriately placed along the length of the support shaft at any one of a plurality of angles which facilitate the practice of any boxing, martial arts or like activities being performed by the user.

Yet additional features of the exercise assembly of the present invention includes an enhanced structuring of the base. As such, the base may be dimensioned and configured to support the shaft in an outwardly and/or upright orientation concurrently to allowing a user to stand on an exposed or outer surface or face of the base. Such positioning of the user is further facilitated by the inclusion of a slip-resistant and/or traction enhancing structure mounted on the outer exposed surface or face. Such a slip-resistant structure would be disposed so as to engage the feet of the user while practicing the intended exercise and or training activity. Other features of one or more additional embodiments of the base may include it being removably but fixedly attached to a supporting surface using any of a variety of connectors. Such connectors may include one or more adhesive type connectors or similarly structured connectors, attachment structures, etc. which allows the fixed positioning of the base on the supporting surface but also allows for its removal from the supporting surface, when not being used.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
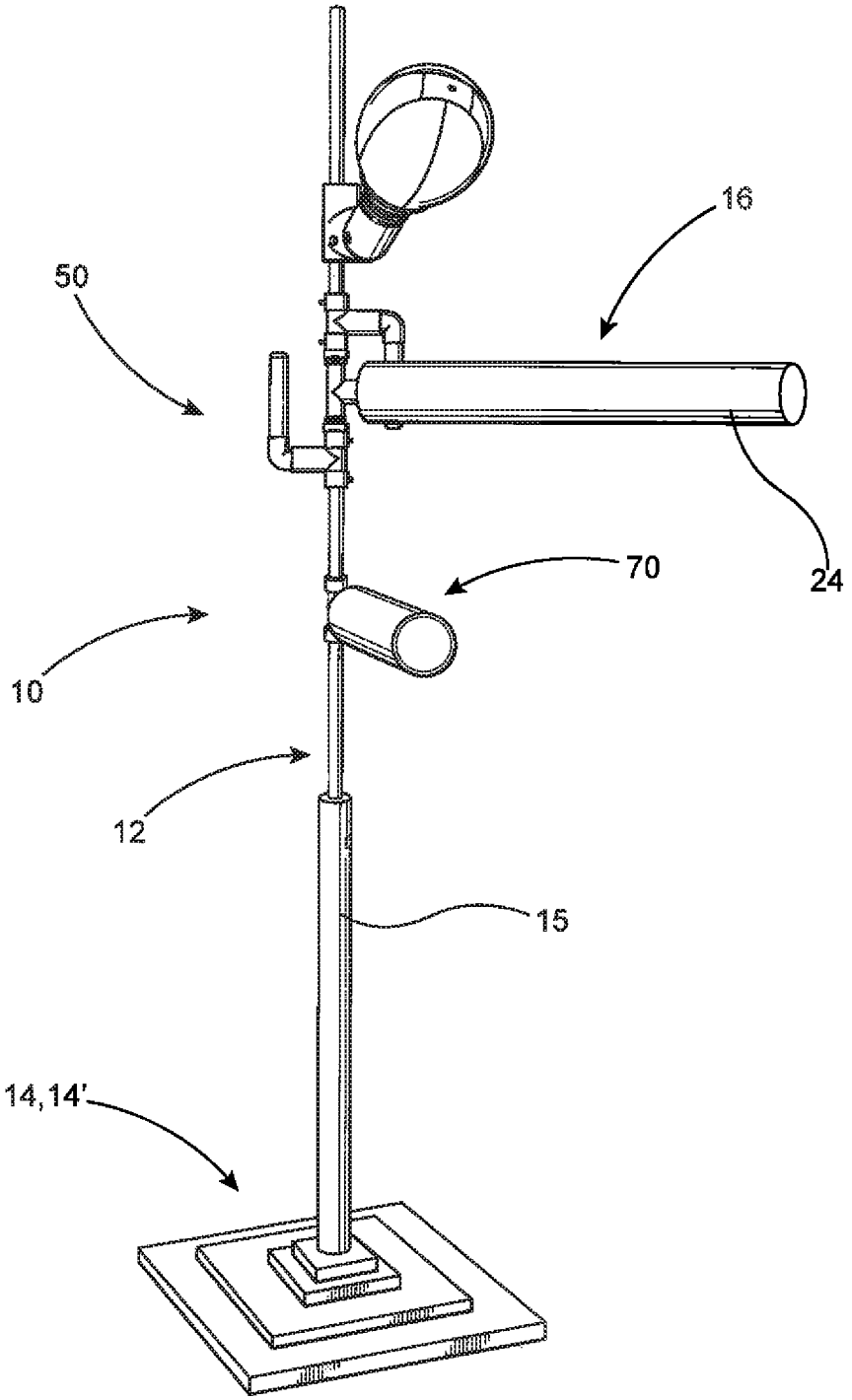
FIG. 1 is a perspective view of one preferred embodiment of an exercise assembly of the present invention.
Figure 2:
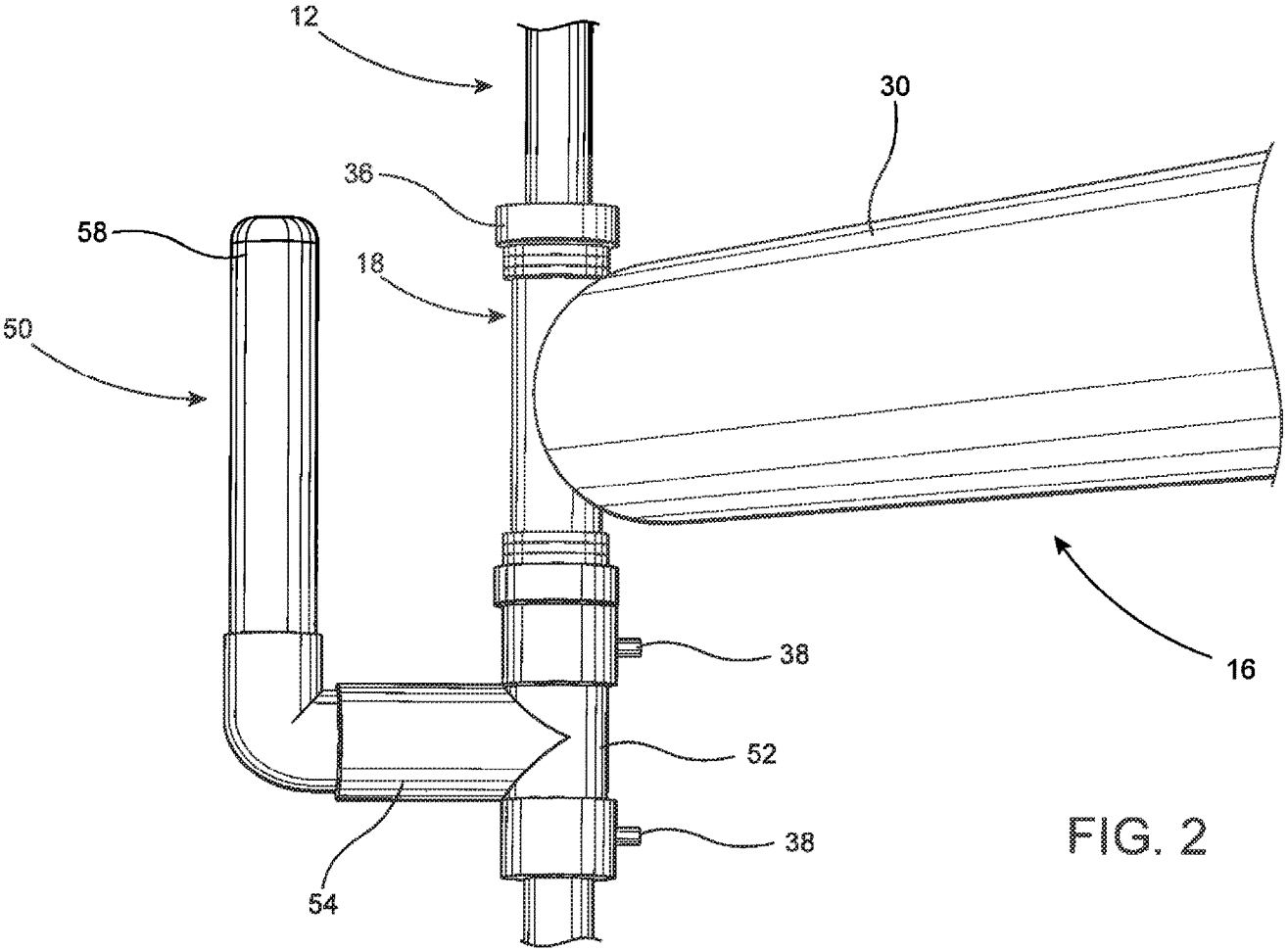
FIG. 2 is a perspective view in partial cutaway disclosing relative positions of the rotating target of the embodiment of FIG. 2 and a resistance assembly which may be cooperatively used therewith.

As represented in the accompanying Figures and with initial, reference to FIG. 1, the present invention is directed to a training assembly generally indicated as 10. The training assembly 10 includes sufficient structural and operative versatility to facilitate its use for both training and exercising. More specifically, the training assembly 10 includes an elongated support shaft or stanchion, generally indicated as 12. In cooperation therewith, a base 14, 14' may be fixedly or removably mounted on a supporting surface such as a floor, ground surface, etc. However, while the vertically upright operative orientation of the exercise assembly 10, as represented in FIG. 1, may be the most popular position of use, the support shaft 12 and cooperative, supporting base 14, 14' may be structured to be oriented in an "inverted orientation", such as by depending from a ceiling surface or extending transversely outward from a side wall or the like.

As also represented in FIG. 1, a reinforcing member 15 may be integrally connected to or otherwise associated with a lower portion of the shaft 12 so as to facilitate its support and mounting on the base 14, 14'. Such reliable mounting of the support shaft, as well as a plurality of target structures mounted thereon is important due to the fact that the support assembly 10 is intended to be repeatedly "struck" as a user performs various boxing, martial arts and/or like activities, while utilizing the exercise assembly 10.

As also represented in FIG. 1, the exercise and/or training assembly 10 includes a plurality of target structures, each of which is intended to receive repeated, forceful blows as the user performs the intended boxing, martial arts, etc. routine. More specifically and with primary reference to FIGS. 1 and 3, the exercise and/or training assembly 10 includes at least one but a possible plurality of rotating targets generally indicated as 16. As will be discussed in greater detail hereinafter, each of the one or more rotating targets 16 are rotationally connected to the support shaft 12 by a rotational fitting, generally indicated as 18, in FIGS. 3 and 5. With primary reference to FIG. 3, each of the one or more rotating targets 16 includes an elongated arm 24 including both a weighted construction generally indicated as 22 and a safety portion generally indicated as 28. The weighted portion 22 preferably comprises an elongated weighted, rigid material member 26, which may be in the form of a rigid material dowel.

As such, the member or dowel 26 extends substantially along at least a majority of the length of the arm 24 and intermediate opposite ends of the arm 24 or intermediate the rotational fitting 18 and the distal end 24' of the arm 24. While the length of the weighted member or dowel 26 may vary, one feature thereof includes the addition of a predetermined amount of weight to the arm 24 and/or rotating targets 16 which will facilitate its continuous rotation about the longitudinal axis of the shaft 12. More specifically and in at least one embodiment such a preferred weight of the arm 24 may be, but is not limited to, being in the range of between 13 and 14 ounces. This predetermined weight may vary depending on the overall structure of the rotating target 16. Further, the overall length of the arm 24 is preferably in the range of between 24 and 25 inches. As represented in FIG. 1 such an extended length of the rotating target 16 and corresponding arm 24 allows it to extend transversely outward from the shaft 12 a significantly greater distance than the other target structures. This extended length further provides a user of the exercise assembly 10 with a greater challenge due to the continuous rotation of the one or more rotating targets 16.

Each of the one or more rotating targets 16 also includes a safety portion 28 defining and extending along the length of the distal end, 24' inwardly towards the rotational fitting 18. The length and overall structure of the safety portion is such as to facilitate the receiving of any forceful blow delivered by the user. Accordingly, an outer end 26' of the weighted member or dowel 26 may be inwardly spaced from the safety portion 28 and the distal end 24' of the arm 24 a sufficient distance to assure that any blow delivered to the rotating target 16 will engage the safety portion 28. Further, the safety portion 28 is formed of a cushioning material such as, but not limited to, a resilient foam type of material which offers at least a predetermined minimal resistance to a blow or punch being thrown by a user. As such, there will be no chance of damage to the user's hand, arm, etc. by the delivery of such a blow to the safety portion 28.

Figure 3:
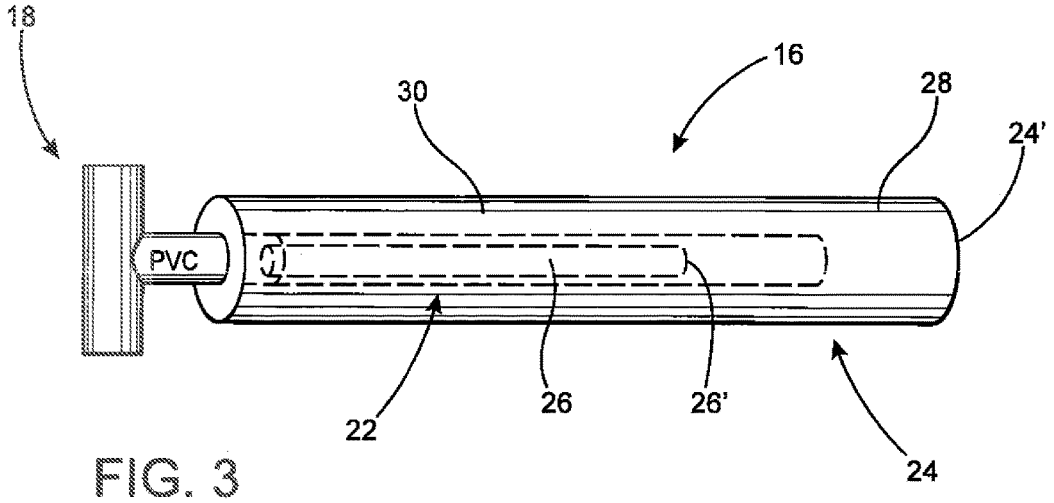
FIG. 3 is a perspective view in detail of a rotating target component of the embodiment of FIG. 1.
Figure 4:
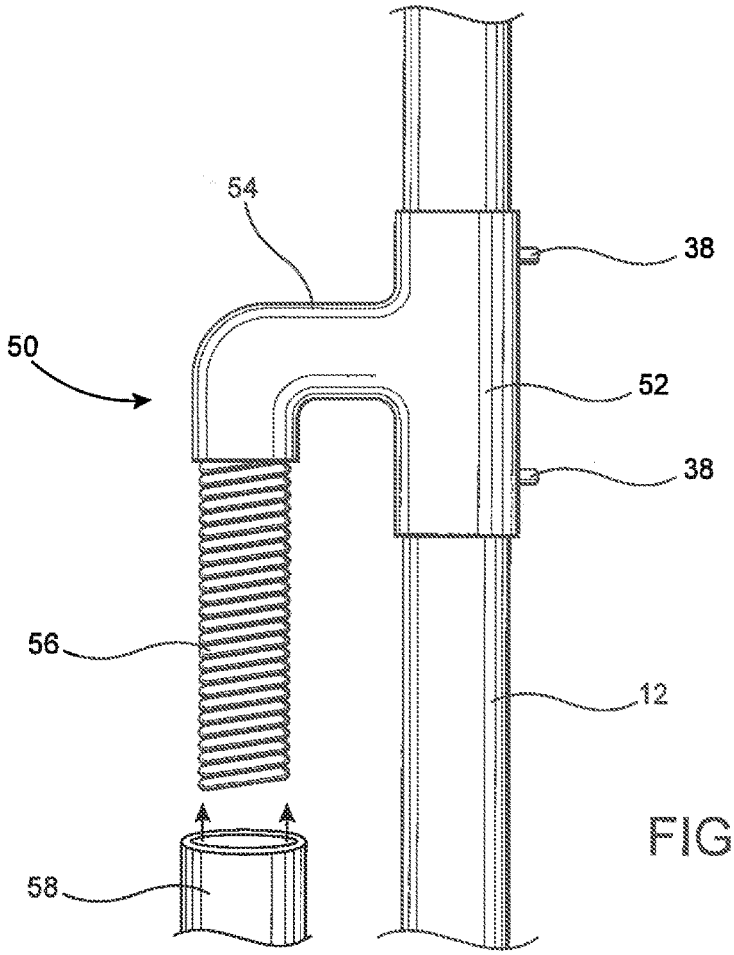
FIG. 4 is a detailed view in partial cutaway and exploded form disclosing structural details of the resistance assembly as represented in the embodiments of FIGS. 1 and 2.

However, the at least minimal, non-damaging resistance provided by the safety portion 28 is sufficient to cause the rotation of the arm 24, about the shaft 12 in the manner intended, when the safety portion 28 and arm 24 are being struck. Additional features which enhance the safety of striking the arm 24 includes the provision of an outer sleeve 30 extending along the length of the arm 24, or at least a majority thereof, in overlying, covering relation to the weighted member or dowel 26. As is represented in FIG. 3 the safety portion 28 may in fact be an integrated part of the sleeve 30 since both the sleeve 30 and the safety portion 28 are formed of the for mentioned and described cushioning material such as a resilient foam material. However, it is emphasized that the safety portion 28 and the sleeve 30 may in fact be different structures, where in the sleeve 30 overlies and covers the safety portion 28.

Figure 5:
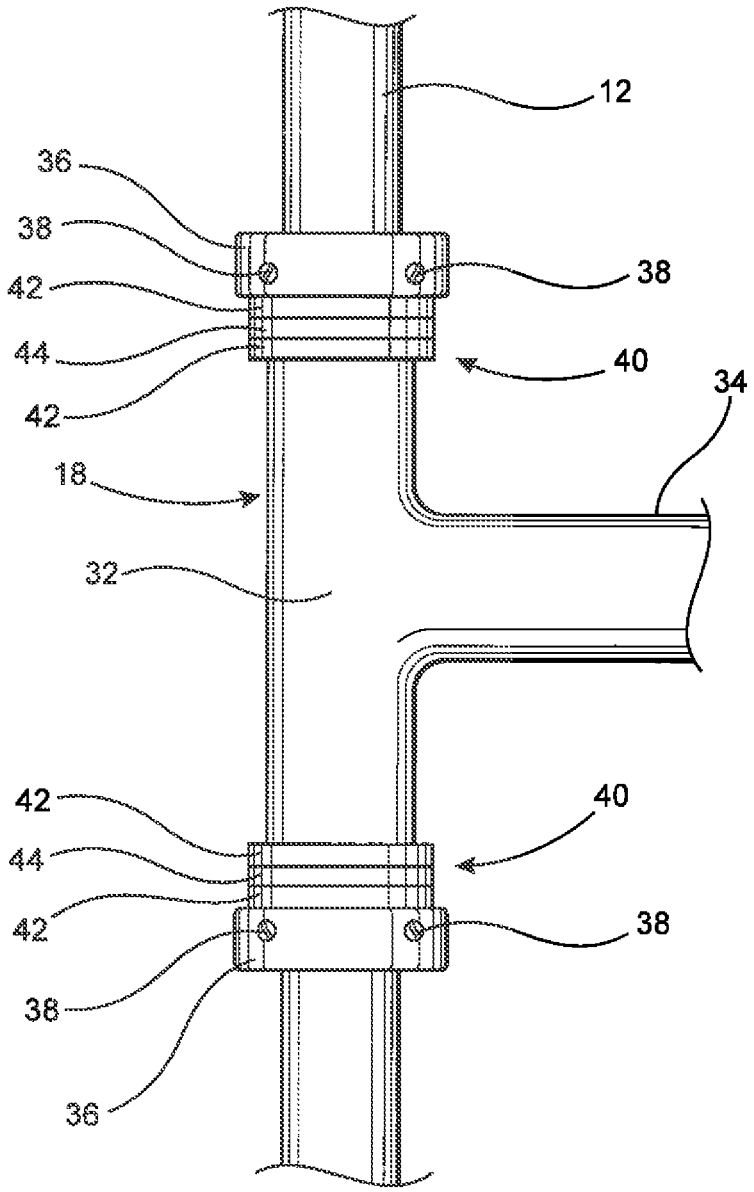
FIG. 5 is a detailed cutaway view of a rotational fitting used to secure and facilitate rotation of the rotating target of the embodiment of FIGS. 1 and 3 relative to the support shaft, in the manner represented in FIG. 1.

As also indicated, at least one preferred embodiment of the exercise assembly 10 includes the cooperative structuring of the arm 24 and the rotational fitting 18, such that the arm 24 continuously rotates about the shaft 12 at least 3 to 4 times when a typical blow or punch is delivered thereto by the user. Accordingly, and with primary reference to FIG. 5, the rotational fitting 18 comprises an elongated primary segment 32 having a hollow interior and an outwardly extending connecting segment 34. When disposed in its operative position, the primary portion 32 is disposed in concentrically surrounding relation to the shaft 12. As indicated the connecting segment 34 extends transversely outward therefrom in connected, supporting relation to a remainder of the arm 24 of the rotating target 16. Therefore, the rotational fitting 18 may include a substantially T-shape configuration. Further, the rotational fitting 18 is adjustably secured along the length of the shaft 12 using at least two, oppositely disposed locking collars 36 movably or adjustably connected to the shaft 12 by a plurality of set screws or like connectors 38. Associated with the rotational fitting 18 and operatively held in place by the locking collars 36 are two bearing assemblies generally indicated as 40. Each of the bearing assemblies 40 include two outwardly disposed washers 42 disposed in a sandwiching relation on opposite sides of a bearing structure 44, such as a thrust bearing or the like. As represented in FIG. 5 the locking collars 36 hold corresponding ones of the bearing assemblies 40 in an operative position relative to opposite open ends of the primary portion 32 of the rotational fitting 18. Therefore, rotation of the connecting segment 34 and the arm 24 of the rotating target 16 connected thereto is facilitated.

As emphasized above, one operative feature of the exercise and/or training assembly 10 is the challenge of the user to respond to the rotating target 16 and/or arm 24 as it continuously rotates a plurality of times about the length of the shaft 12. As further indicated this adds to the overall dexterity of the user and provides a more challenging workout.

However, yet another operative feature of the rotating target 16 is its intended "restricted rotation" through a rotational path of less than 360° or less than a complete circular path about the longitudinal axis of the shaft 12. Accordingly, at least one preferred embodiment of the exercise and/or training assembly 10 further comprises a resistance assembly 50 which is adjustably but fixedly secured to the shaft 12 by a fitting 52, utilizing one or more sets screws 38. More specifically, the resistance assembly 50 is disposed in a predetermined location relative to the rotational path of a corresponding one of a possible plurality of arms 24 of one or more rotating targets 16. Therefore, the resistance assembly may be purposefully disposed in an "interruptive position" relative to the rotational path of the arm 24. As such, rotation of the arm will be restricted and/or prevented from accomplishing a complete 360° arc of rotation.

Further, the resistance assembly 50 includes a support segment 54 which may be considered a part of the fitting 52 adjustably connected to the shaft 12. Also, the resistance assembly 50 includes a biasing or spring structure 56 which is disposed to engage the arm 24 during its rotation. For purposes of safety, the biasing or spring structure 56 may be covered by a sleeve member 58, which may also be formed of a cushioning material of the type described above and from which the safety portion 28 and the sleeve 30 of the arm 24 is formed. In addition, the biasing structure 56 is disposed and calibrated or otherwise structured to stop rotation of the arm 24 and deliver or impose a directional, biasing force on the rotating arm 24. Such a biasing force will not only stop the rotation of the arm 24, but force it to rotate in an opposite direction, back towards the user. More specifically, the biasing structure 56 of the resistance assembly 50 will exert a biasing force on the rotating arm 24 in a direction which is substantially opposite to the initial direction of rotation of the arm 24 along its intended rotational path of travel. This will serve to reverse and redirect the rotation of the arm 24 back towards the user. In turn, the user can appropriately react by purposefully "ducking" the returning rotating arm 24 and or delivering an additional defensive blow thereto, dependent on the particular exercise or training activity which the user is practicing. It should be noted that a plurality of such resistance of assemblies 50 may be utilized with correspondingly disposed ones of a plurality of rotating target 16.

Figure 6:
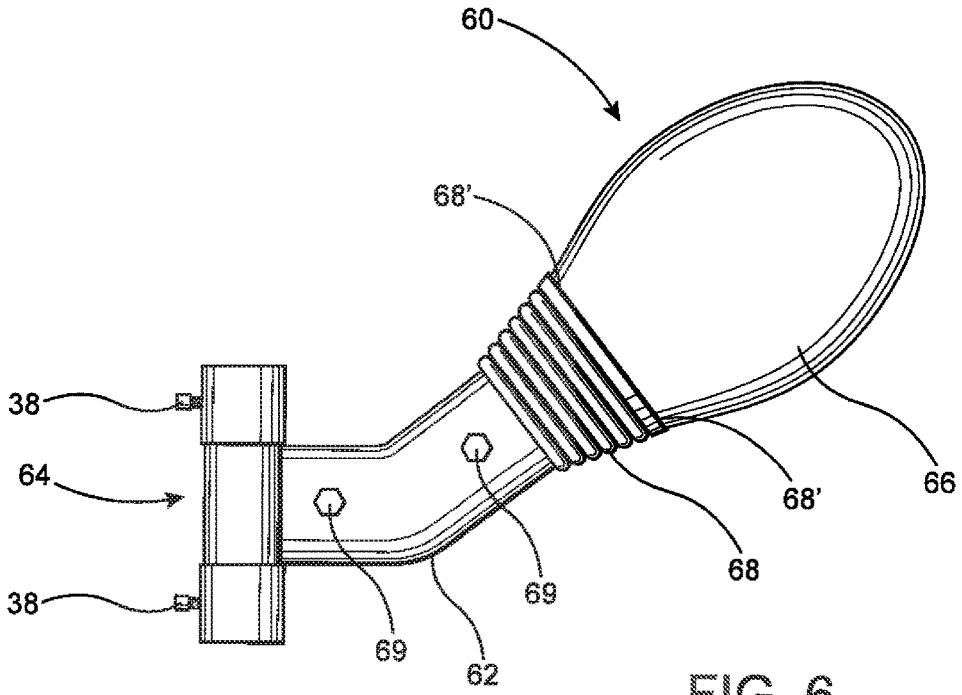
FIG. 6 is a side detail view of a head target also represented in an operative position in FIG. 1.
Figure 7:
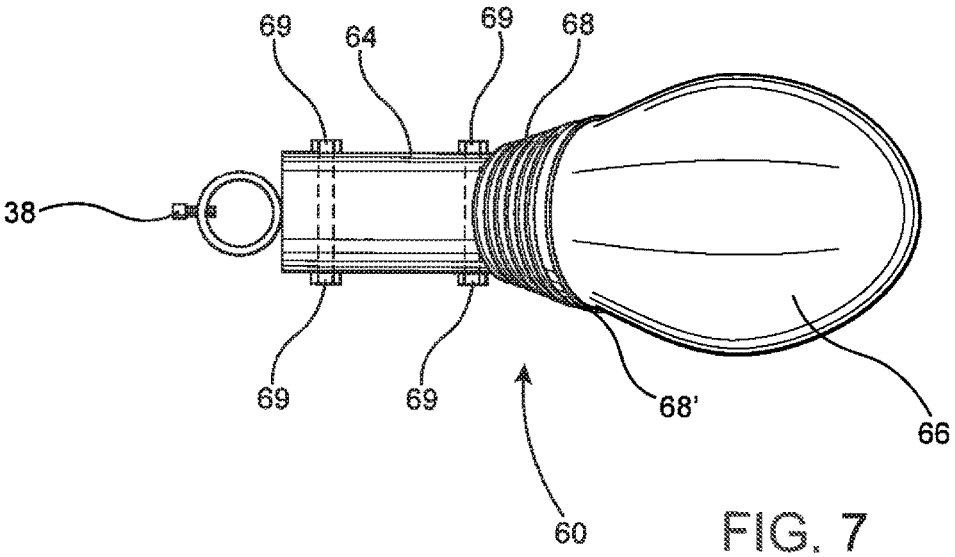
FIG. 7 is a top view of the embodiment of FIG. 6.

As represented in FIGS. 1, 6 and 7 the versatility of the exercise assembly of the present invention is further demonstrated by the provision of a head target 60. The head target 60 includes a support member which is preferably a rigid arm segment 62 adjustably secured along the length of the shaft 12 by fitting 64. The fitting 54 is intended to adjustably but fixedly dispose the head target 60 at a predetermined or preferred location along the length of the shaft 12 and at a preferred or appropriate height. The height and/or position of the head target 60 along the length of the shaft 12 may be dependent on the height or stature of the user or, as set forth above, the particular activity being practiced by the user is.

Accordingly, the head target 60 includes a target section 66 which defines a distal or outer end of the head target 60. The target section is structured to be struck or receive a blow from the user. In addition, a spring segment 68 is included as part of the head target 60 and is disposed in movably, resiliently interconnecting relation between the support arm segment 62 and the inner or proximal end of the target section 66. Further, the spring segment 68 may have a substantially conical configuration, which serves to enhance the support of the target section 66 and maintain it in a preferred orientation or position.

As such, the conically configured spring 68 extends divergently outward such that the larger and more open end thereof 68' is disposed in at least partially surrounding and/or gripping relation to the proximal end of the target section 66, as clearly represented in FIGS. 6 and 7. The specific dimension, configuration and overall structuring of the head structure 60 may vary and as such may require the use of one or more connectors 69 serving to securely but appropriately connected the target section 66 to the outer end of the support segment 62 in combination with the operative placement of the spring structure 68. Such structuring of the head target 60 also facilitates its use as a "speed bag" in a conventional manner in which such speed bags are used. In order to provide a more realistic appearance and disposition of the head target 60 and make it more "available" to receive repeated blows or punches from a user, it may be disposed at an acute angle relative to the length of the shaft 12 and be directed either upwardly or downwardly at such an acute angle.

As represented in FIG. 1, at least one preferred embodiment of the exercise assembly 10 also include one or more fixed targets 70 which may be similarly structured as the head target 60. More specifically, each of the one or more fixed targets 70 may include a support arm segment 62, a target portion or section 66 structured, to receive a blow from the user. Also, each of the one or more fixed targets 70 may be fixedly but adjustably secured to the shaft 12 by fitting 64. Further, in order to facilitate the target section 66 absorbing a plurality of blows or punches, a resilient, spring segment 68 may also serve to interconnect the target section 66 with the support segment 62, of the one or more fixed targets 70. Moreover, the spring element in both the head target 60 and one or more fixed targets 70 will be calibrated and/or otherwise structured to absorb the force of a blow exerted on the target section 66, but cause a return the target section 66 to an original outwardly extending orientation as represented in the Figures. Also, as with the head target 60, the structural components of the each of the fixed targets 70, as set forth above, are such as to absorb a punch or blow from the user in a manner which does not cause a displacement and/or rotation of the fixed targets 70 about the shaft 12. Further, the one or more fixed targets 70 may be strategically or appropriately placed along the length of the support shaft 12 at any one of a plurality of outwardly extending directions, which facilitate the practice of any boxing, martial arts or like activities being performed by the user. As also represented in FIG. 1 each of the one or more fixed targets 70 may have an elongated substantially linear configuration rather than the acutely angled configuration of the head target 60.

Figure 8:
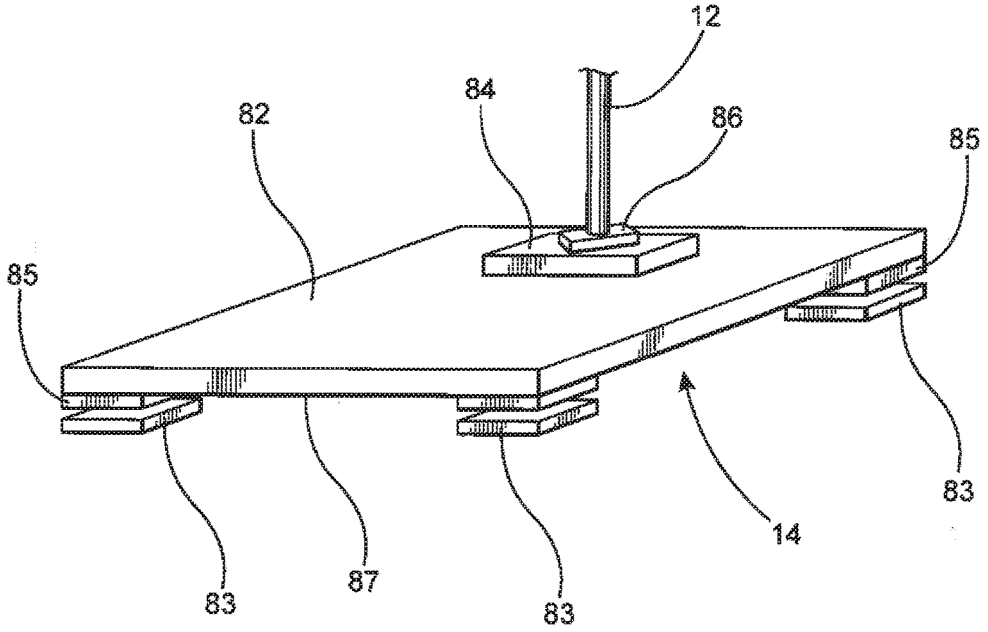
FIG. 8 is a perspective view in partial cutaway of one embodiment of a base in accord with the embodiment of FIG. 1.
Figure 9:
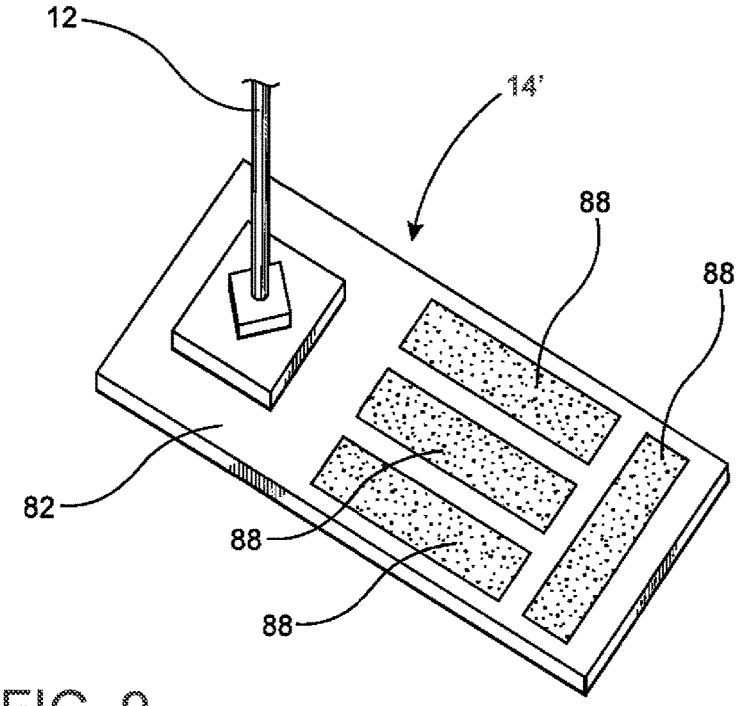
FIG. 9 is a perspective view in partial cutaway of yet another preferred embodiment of the base.

With primary reference to FIGS. 8 and 9, the aforementioned base 14 and 14' are provided to support the shaft 12 in an upright and/or other outwardly extending orientation relative thereto. In at least one preferred embodiment as represented in FIG. 8, the base 14 includes a substantially planar platform having an outer face or surface 82. The support shaft 12 is removably or fixedly connected to the base 14 and may include a plurality of supplementary supports in the form of plates, blocks, etc. 84 and 86 disposed in engaging, supporting relation to the corresponding end of the shaft 12. Such support may be considered frequently necessary due to the plurality of target structures, as set forth above, receiving repeated blows or punches from a user.

As also represented in FIG. 8, the base 14 may be removably secured to a supporting surface such as a floor or the like. In doing so, a plurality of mounting members 83 may be fixedly or removably secured to the corresponding support surface and be disposed in an orientation so as to be removably connected to corresponding mounting structures 85 formed on the under face or under surface 87 of the base 80. Interconnection between the mounting members 83 and 85 may be accomplished by an appropriate adhesive material or other sufficiently strong connecting structures to maintain the stability of the base 14 while in use.

As represented in FIG. 9, yet another preferred embodiment of the base is represented as 14'. In this embodiment, the planar platform is sufficiently dimensioned and configured to have a user being supported on an outer face or surface 82 thereof. As such, the base 14' is structured to support the shaft in an outwardly and/or upright orientation concurrently to allowing the user to stand on the exposed or outer surface or face 82 of the base 80'. Such positioning of the user is further facilitated by the inclusion of a slip-resistant and/or traction enhancing structure 88 mounted on the outer exposed surface or face 82. Such a slip-resistant structure 88 may comprise a single segment or, as represented in FIG. 9A plurality of segments. In either structural variation, the slip-resistant structure 88 would be disposed so as to engage the moving feet of the user, while practicing the intended exercise and or training activity.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An exercise assembly structured to be struck by a user, said exercise assembly comprising:

a support shaft disposed on and extending outwardly from a supporting surface, at least one rotating target rotationally connected to said support shaft and extending outward therefrom;

a resistance assembly adjustably mounted on said shaft into and out of an interruptive position relative to a rotational path of travel of said one rotating target, and said interruptive position comprising said resistance assembly disposed in rotation restricting engagement with said one rotating target.

2. The exercise assembly as recited in claim 1 wherein said resistance assembly and said one rotating target are cooperatively disposed to restrict rotation of said rotating target along said rotational path of travel, about said support shaft to less than 360°, when said resistance assembly is in said interruptive position.

3. The exercise assembly as recited in claim 2 wherein said resistance assembly comprises a biasing structure disposed in engaging relation to said one rotating target, when in said interruptive position.

4. The exercise assembly as recited in claim 3 wherein said biasing structure is disposed and structured to exert a driving force on said one rotating target in a direction opposite to that of said rotational path of travel.

5. The exercise assembly as recited in claim 1 wherein said rotating target comprises an elongated arm including a predetermined weighted construction and a safety portion disposed thereon.

6. The exercise assembly as recited in claim 5 wherein said safety portion comprises a predetermined length of the distal end of said arm being formed of a cushioning material.

7. The exercise assembly as recited in claim 6 wherein said cushioning material is sufficiently flexible to present a non-damaging resistance to the user, when struck thereby.

8. The exercise assembly as recited in claim 7 wherein said cushioning material comprises a flexible foam material.

9. The exercising assembly as recited in claim 6 wherein said weighted construction comprises an elongated, rigid material member disposed on an interior of said arm in spaced relation to said safety portion.

10. The exercise assembly as recited in claim 9 wherein said one arm comprises an outer sleeve of flexible, non-rigid material extending in overlying, covering relation to said weighted construction and said safety portion.

11. The exercise assembly as recited in claim 9 wherein said weighted construction is disposed and structured to facilitate at least a predetermined number of continuous rotations of said one arm about said shaft.

12. The exercise assembly as recited in claim 11 wherein said predetermined number of continuous rotations comprises at least four rotations.

13. The exercise assembly as recited in claim 5 further comprising a rotational fitting including a primary portion and an outwardly extending connecting segment, said primary portion structured for concentric, surrounding disposition about said shaft and said connecting segment dimensioned and configured for attachment to a proximal end of said arm.

14. The exercise assembly as recited in claim 13 further comprising two bearing assemblies each rotationally interconnecting a different end of said primary portion to said shaft.

15. The exercise assembly as recited in claim 14 further comprising two locking collars each disposed adjacent a different one of said two bearing assemblies; each of said locking collars adjustably and movably secured to said shaft along a length thereof.

16. The exercise assembly as recited in claim 5 wherein said arm comprises a predetermined length of generally about 24 inches.

17. The exercise assembly as recited in claim 1 further comprising a head target adjustably connected to said shaft at a predetermined height relative to the user; said head target including a target portion disposed and structured to be struck by the user and a support member interconnecting said target portion to the shaft.

18. The exercise assembly as recited in claim 17 further comprising a spring segment movably and resiliently connecting said target portion to said support member, said support member and said spring segment cooperatively disposed to orient said target portion at an outwardly acute angle relative to said shaft.

19. The exercise assembly as recited in claim 17 further comprising a spring segment including a substantially conical configuration extending divergently outward from an outer end of said support member into at least partially surrounding relation with a proximal end of said target portion.

20. The exercise assembly as recited in claim 1 further comprising a base structured and disposed to support said shaft on the supporting surface.

21. The exercise assembly as recited in claim 20 wherein said base comprises at least one slip-resistant structure disposed on an exposed surface of said base, said base and said slip-resistant structure cooperatively dimensioned and configured to support the user on said base concurrent to engagement of the feet of the user with said slip-resistant structure.

22. The exercise assembly as recited in claim 21 wherein said base is removably secured to the supporting surface.

23. The exercise assembly as recited in claim 1 further comprising at least one fixed target including a target section structured to be struck by the user and a support member interconnecting said target section to the shaft; a spring segment movably and resiliently connecting said target portion to said support member.

24. The exercise assembly as recited in claim 23 further comprising said spring segment including a substantially conical configuration extending divergently outward from an outer end of said support member into at least partially surrounding, supporting relation with a proximal end of said target section.

* * * * *